US007886463B2

(12) United States Patent
Greenberg et al.

(10) Patent No.: US 7,886,463 B2
(45) Date of Patent: Feb. 15, 2011

(54) PIPELINE PADDING MACHINE

(75) Inventors: Evan Greenberg, Channelview, TX (US); Giordano Grassi, San Pancrazio (IT)

(73) Assignee: Worldwide Machinery Pipeline Division, Channelview, TX (US)

( * ) Notice: Subject to any disclaimer, the term of this patent is extended or adjusted under 35 U.S.C. 154(b) by 857 days.

(21) Appl. No.: 11/170,264

(22) Filed: Jun. 29, 2005

(65) Prior Publication Data

US 2007/0000156 A1 Jan. 4, 2007

(51) Int. Cl.
*E02F 3/02* (2006.01)
*F16L 3/00* (2006.01)

(52) U.S. Cl. ..... 37/142.5; 405/179; 180/321; 180/326

(58) Field of Classification Search ..... 37/142.5; 405/174, 179; 241/101.742, 101.763, 101.773; 180/322, 321, 326
See application file for complete search history.

(56) References Cited

U.S. PATENT DOCUMENTS 1,672,212 A * 6/1928 Hale ..... 180/24.01
1,804,423 A 5/1931 Krenzke
1,917,652 A 7/1933 Krieger
2,669,338 A * 2/1954 Kling ..... 198/513
2,696,287 A * 12/1954 Foust ..... 198/316.1
3,091,999 A * 6/1963 MacDonald ..... 404/101
3,330,578 A * 7/1967 Kress et al. ..... 280/423.1
3,416,419 A * 12/1968 Kronholm ..... 404/122
3,446,026 A * 5/1969 Fikse ..... 405/129.15
3,451,571 A * 6/1969 Brisson ..... 414/499
3,471,953 A * 10/1969 Wyatt ..... 37/142.5
3,479,755 A * 11/1969 Schropp ..... 37/422
3,701,422 A * 10/1972 Downey ..... 209/241
3,901,617 A * 8/1975 Herbst ..... 404/117
3,908,292 A * 9/1975 Harris ..... 37/142.5
3,972,406 A * 8/1976 MacDonald ..... 198/518
3,981,089 A 9/1976 Burrows
4,011,936 A * 3/1977 Hall ..... 198/517

(Continued)

FOREIGN PATENT DOCUMENTS

JP 04103476 A * 4/1992

OTHER PUBLICATIONS

CRC-Evans Pipeline Equipment product information, "Selfloading Superscreen Pipeline Padding Machine," undated, 2 pgs.

(Continued)

*Primary Examiner*—Thomas A Beach
(74) *Attorney, Agent, or Firm*—Smith IP Services, P.C.

(57) ABSTRACT

A pipeline padding machine includes two control station locations. One location is for controlling operation of the machine while the machine is operated on one side of a ditch, and the other location is for controlling operation of the machine while the machine is operated on an opposite side of the ditch. Another pipeline padding machine includes a material escalator assembly for elevating material, and a material conditioning assembly for conditioning the material. Another pipeline padding machine includes a main frame attached to a transport assembly for transporting the machine, a material escalator assembly for elevating material, and a cutting edge for cutting through the material prior to the material being elevated by the escalator assembly. The escalator assembly is pivotable relative to the main frame, and the cutting edge is pivotable relative to the escalator assembly.

1 Claim, 6 Drawing Sheets

U.S. PATENT DOCUMENTS

| | | | | | |
|---|---|---|---|---|---|
| 4,057,917 | A | | 11/1977 | Burrows | |
| 4,123,857 | A | * | 11/1978 | Enters et al. | 37/252 |
| 4,147,227 | A | * | 4/1979 | van der Lely | 180/322 |
| 4,212,250 | A | * | 7/1980 | Burgess | 105/50 |
| 4,221,505 | A | | 9/1980 | Taylor-Smith | |
| 4,290,820 | A | * | 9/1981 | Swisher et al. | 134/6 |
| 4,333,561 | A | * | 6/1982 | Schlegel | 198/703 |
| 4,372,617 | A | * | 2/1983 | Zamboni | 299/24 |
| 4,377,365 | A | | 3/1983 | Layh | |
| 4,505,356 | A | * | 3/1985 | Baier et al. | 180/322 |
| 4,616,957 | A | | 10/1986 | Burrows et al. | |
| 4,633,602 | A | | 1/1987 | Layh et al. | |
| 4,648,776 | A | * | 3/1987 | Hradil et al. | 414/565 |
| 4,664,791 | A | | 5/1987 | McClain et al. | |
| 4,697,696 | A | | 10/1987 | Howe et al. | |
| 4,805,703 | A | | 2/1989 | Carlsson | |
| 4,840,269 | A | | 6/1989 | Anderson | |
| 4,861,461 | A | | 8/1989 | Utterback | |
| 4,912,862 | A | | 4/1990 | Bishop et al. | |
| 4,921,066 | A | * | 5/1990 | Conley | 180/322 |
| 4,948,299 | A | | 8/1990 | Cronk, Jr. et al. | |
| 4,955,756 | A | | 9/1990 | Klamar | |
| 5,084,991 | A | | 2/1992 | Cronk, Jr. | |
| 5,097,610 | A | | 3/1992 | Bishop | |
| 5,120,433 | A | | 6/1992 | Osadchuk | |
| 5,137,144 | A | | 8/1992 | Uehara | |
| 5,183,160 | A | | 2/1993 | McClain | |
| 5,195,260 | A | | 3/1993 | Osadchuk | |
| RE34,289 | E | | 6/1993 | McClain et al. | |
| 5,259,699 | A | | 11/1993 | Klamar | |
| 5,261,171 | A | | 11/1993 | Bishop | |
| 5,271,168 | A | | 12/1993 | Wilson et al. | |
| 5,344,254 | A | * | 9/1994 | Sartain | 404/104 |
| 5,363,574 | A | | 11/1994 | Osadchuk | |
| 5,421,108 | A | | 6/1995 | Stewart | |
| 5,430,962 | A | | 7/1995 | Osadchuk | |
| 5,479,726 | A | | 1/1996 | Bishop | |
| 5,493,796 | A | | 2/1996 | Ballew et al. | |
| 5,540,003 | A | | 7/1996 | Osadchuk | |
| 5,551,356 | A | | 9/1996 | Post | |
| 5,694,709 | A | | 12/1997 | Cronk, Jr. et al. | |
| 5,741,087 | A | | 4/1998 | Osadchuk | |
| 5,743,030 | A | | 4/1998 | Sirr | |
| 5,765,967 | A | | 6/1998 | Klaymar | |
| 5,771,612 | A | | 6/1998 | Lynch | |
| 5,788,168 | A | | 8/1998 | Gilbert et al. | |
| 5,823,707 | A | | 10/1998 | Lodovico | |
| 5,833,047 | A | | 11/1998 | Howe | |
| 5,846,026 | A | | 12/1998 | Gilbert et al. | |
| 5,864,971 | A | * | 2/1999 | Jones | 37/410 |
| 5,938,373 | A | | 8/1999 | Scudder | |
| 6,029,378 | A | | 2/2000 | Cronk, Jr. | |
| 6,055,749 | A | | 5/2000 | Cronk, Jr. | |
| 6,108,945 | A | | 8/2000 | Cronk, Jr. | |
| 6,125,558 | A | | 10/2000 | Stewart | |
| 6,138,837 | A | | 10/2000 | Cruz et al. | |
| 6,158,925 | A | | 12/2000 | Schleining et al. | |
| 6,237,257 | B1 | | 5/2001 | Cronk, Jr. | |
| 6,318,930 | B1 | | 11/2001 | Scudder | |
| 6,477,794 | B1 | * | 11/2002 | Hoffmann | 37/219 |
| 6,502,333 | B1 | | 1/2003 | Striegel | |
| 6,695,127 | B1 | * | 2/2004 | Dobranski | 198/711 |
| 6,718,659 | B2 | | 4/2004 | Foutz et al. | |
| 6,834,447 | B1 | | 12/2004 | Currey | |
| 6,953,166 | B2 | | 10/2005 | Schenk | |
| 7,186,059 | B2 | * | 3/2007 | Barnes | 405/175 |
| 2004/0211092 | A1 | | 10/2004 | Barnes | |

OTHER PUBLICATIONS

Outlaw Padding Company product information, "Rob'n Fines to Pad Your Lines", undated, 2 pgs.

International Search Report and Written Opinion issued for International Application No. PCT/US07/81071 dated May 6, 2008 (7 pages).

Office Action issued Jan. 5, 2009, for U.S. Appl. No. 11/551,130, 32 pages.

Office Action issued Mar. 18, 2009, for U.S. Appl. No. 11/548,316, 42 pages.

Office Action issued Sep. 8, 2009, for U.S. Appl. No. 11/548,316, 15 pages.

Office Action issued Apr. 14, 2010, for U.S. Appl. No. 11/548,316, 21 pages.

Office Action issued Jul. 29, 2010, for U.S. Appl. No. 11/548,316, 21 pages.

* cited by examiner

PIPELINE PADDING MACHINE

BACKGROUND

The present invention relates generally to equipment utilized in conjunction with pipeline operations and, in an embodiment described herein, more particularly provides a pipeline padding machine.

In constructing pipelines, a ditch is typically dug by excavating material from the ground, and then a pipe (including many interconnected pipe sections) is positioned in the ditch. The excavated material can include objects (such as large rocks, sharp objects, etc.) which could damage the pipe or otherwise hinder the pipeline operation (such as by creating large voids in the ditch, etc.).

Therefore, instead of merely covering the pipe by pushing the excavated material back into the ditch, only a portion of the excavated material is used around the pipe in the ditch. This portion of the excavated material is the relatively fine portion and is known to those skilled in the art as "padding" since it forms a protective layer surrounding the pipe. The remainder of the excavated material can be deposited in the ditch above the padding if desired.

Several machines have been developed to separate the padding from the remainder of the excavated material and place the padding in the ditch about the pipe. However, these prior padding machines typically have one or more shortcomings. For example, these padding machines may not adequately provide for efficient and convenient use of the machine on either side of a ditch, or for optimum collection and transport of the excavated material, etc.

Therefore, it may be seen that improvements are needed in the art of pipeline padding machines. It among the objects of the present invention to provide such improvements.

SUMMARY

In carrying out the principles of the present invention, a pipeline padding machine is provided which solves at least one problem in the art. One example is described below in which the padding machine is designed to permit convenient control of the machine operations no matter on which side of a ditch the machine is positioned. Another example is described below in which the padding machine is designed to efficiently collect and process material.

In one aspect of the invention, a pipeline padding machine is provided which includes at least two control station locations. One control station location is used for controlling operation of the machine while the machine is operated on one side of a ditch, and another control station location is used for controlling operation of the machine while the machine is operated on an opposite side of the ditch. Different sets of control devices may be positioned at the control station locations, or the same set of control devices may be displaced between the control station locations.

In another aspect of the invention, a pipeline padding machine is provided which includes a material escalator assembly for elevating material, and a material conditioning assembly for conditioning the material. The conditioning assembly may break up the material into smaller pieces, crush ice in the material, sweep the material toward the escalator assembly, or otherwise condition the material.

In yet another aspect of the invention, a pipeline padding machine is provided which includes a main frame attached to a transport assembly for transporting the machine, a material escalator assembly for elevating material, and a cutting edge for cutting through the material prior to the material being elevated by the escalator assembly. The escalator assembly is pivotable relative to the main frame, and the cutting edge is pivotable relative to the escalator assembly.

The pipeline padding machine may be provided with an escalator flight design which allows wet material to be elevated, and/or which allows a greater quantity of material to be elevated while preventing the material from collecting at sides of the escalator assembly.

The pipeline padding machine may be provided with vertically adjustable side walls for funneling the material toward the escalator assembly. Preferably, the side walls are vertically adjustable relative to the cutting edge. Among other benefits, this permits the side walls to be positioned at or above a ground surface when the cutting edge is used to cut into the ground surface to collect previously undisturbed soil.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations and configurations, without departing from the principles of the present invention. The embodiments are described merely as examples of useful applications of the principles of the invention, which is not limited to any specific details of these embodiments. In the following description of the representative embodiments of the invention, directional terms (such as "above", "below", "upper", "lower", etc.) are used for convenience in referring to the accompanying drawings.

Figure 1:
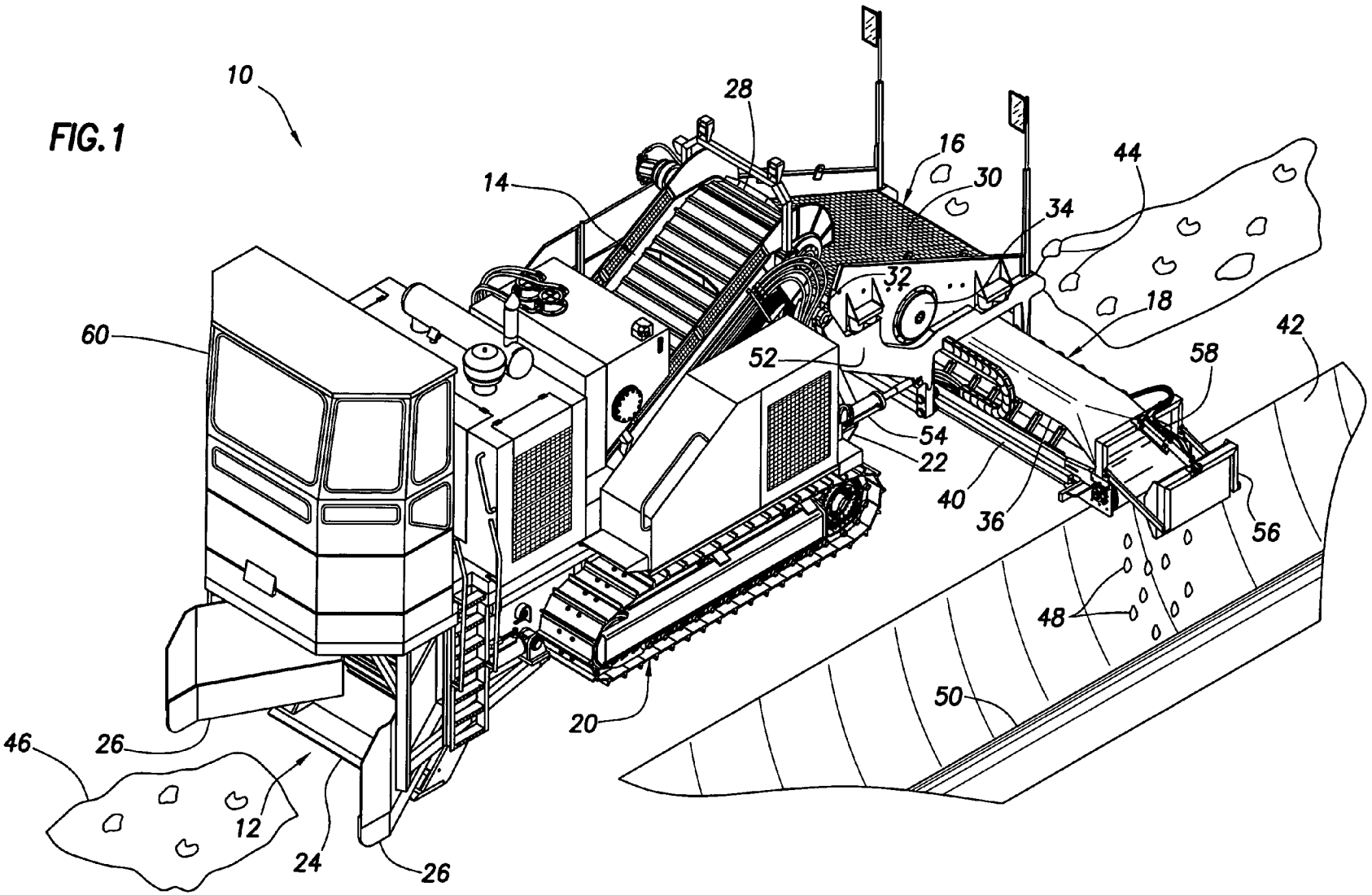
FIG. 1 is an isometric view of a pipeline padding machine embodying principles of the present invention.

Representatively illustrated in FIG. 1 is a pipeline padding machine 10 which embodies principles of the present invention. The machine 10 includes a material collection assembly 12 for gathering material 46 alongside a ditch 42 in which pipe 50 is laid.

The material 46 is typically the same material which was previously excavated to form the ditch 42. However, this is not necessary. For example, the material 46 could be transported from another location, and/or the machine 10 may be used to collect previously undisturbed material from a ground surface as described more fully below.

The machine 10 includes a material escalator assembly 14 for elevating the material 46 from the material collection assembly 12 and depositing the material onto a separator assembly 16. The separator assembly 16 separates the material 46 into a relatively fine padding 48 and a relatively coarse residue 44.

The padding 48 is deposited onto a conveyor assembly 18 which transports the padding laterally to the ditch 42. The padding 48 is deposited from the conveyor assembly 18 into the ditch 42.

A transport assembly 20 is used to transport the machine 10 along the side of the ditch 42. A main frame 22 is attached to the transport assembly 20 for supporting the collection, escalator, separator and conveyor assemblies 12, 14, 16, 18.

The collection assembly 12 includes a cutting edge 24 for cutting through the material 46 piled alongside and generally parallel to the ditch 42, and side walls 26 which are shaped to funnel the material toward a lower end of the escalator assembly 14. As described more fully below, the side walls 26 are vertically adjustable relative to the cutting edge 24, and the cutting edge is pivotable relative to the escalator assembly 14.

The escalator assembly 14 includes a flight of individual sections 28 which are used to elevate the material 46 from the collection assembly 12 and deposit the material onto the separator assembly 16. The escalator assembly 14 is pivotable relative to the main frame 22 about a pivot 32 to thereby vertically adjust the lower end of the escalator assembly. Preferably, the lower end of the escalator assembly 14 is vertically adjustable from about one foot downward to about four feet upward relative to ground level to compensate for various terrain slopes and material collection requirements.

The fight sections 28 may be specially configured so that each flight section can transport a greater quantity of material 46, can transport wet material, and can prevent the material from collecting at the sides of the escalator assembly 14, as described more fully below.

The separator assembly 16 includes a screen 30 which is inclined downward toward the rear of the machine 10. A shaker 34 vibrates the screen 30. The screen 30 has openings sized to permit the relatively fine padding material 48 to pass downward therethrough, while the relatively coarse residue 44 travels across the top of the screen and eventually falls off of the separator assembly 16 onto the ground alongside the ditch 42. Note that the screen 30 has a much larger area as compared to conventional padding machines.

The conveyor assembly 18 includes a belt 36 and rollers 38 (not visible in FIG. 1) mounted to rails 40. The belt 36 is positioned beneath the screen 30 so that the padding material 48 is deposited onto the belt after passing through the screen. The belt 36 transports the padding material 48 laterally, and the padding material then drops off of the belt into the ditch 42.

The rails 40 are used to permit the conveyor assembly 18 to be adjusted laterally, for example, to compensate for varying lateral distances between the machine 10 and the ditch 42. The rails 40 also permit the conveyor assembly 18 to be extended outwardly from either lateral side of the machine 10 so that the machine may be used on either lateral side of the ditch 42.

A deflector 56 is attached to the outer end of the conveyor assembly 18. The deflector 56 is used to more accurately position the padding 48 about the pipe 50 as it falls from the belt 36. A hydraulic cylinder 58 or other type of actuator may be used to pivot or otherwise position the deflector 56 relative to the outer end of the belt 36.

The conveyor assembly 18 may be pivoted so that it is generally vertical during transport of the machine 10 to and from a worksite.

The separator and conveyor assemblies 16, 18 are mounted on a frame 52 which is pivotably mounted to the main frame 22 at the pivots 32. Hydraulic cylinders 54 are used to pivot the frame 52 relative to the main frame 22, but other types of actuators may be used if desired.

Thus, the separator and conveyor assemblies 16, 18 are pivotable relative to the main frame 22 to thereby allow the belt 36 to remain generally horizontal and allow the screen 30 to remain at a desired inclination even though the machine 10 may traverse terrain having varying slopes. That is, although the machine 10 may travel uphill or downhill at varying inclines, the belt 36 can be maintained generally horizontal and the screen 30 can be maintained at a desired inclination by pivoting the frame 52 as needed relative to the main frame 22.

It will be appreciated that many functions need to be controlled in operation of the machine 10. Among these are: speed and direction of transport of the machine 10 by the transport assembly 20, position of the cutting edge 24, speed and direction of travel of the flight sections 28, pivoting of the escalator assembly 14 relative to the main frame 22, pivoting of the frame 52 relative to the main frame 22, operation of the shaker 34, speed and direction of the belt 36, lateral position of the conveyor assembly 18, position of the deflector 56, etc. Various control devices (such as switches, control valves, etc. of the type known to those skilled in the art) are used to control these functions.

In the embodiment of the machine 10 as depicted in FIG. 1, the control devices are not visible. However, the control devices are located within an enclosed cab 60 attached above the collection assembly 12 and the lower end of the escalator assembly 14. Note that the cab 60 pivots with the escalator assembly 14 relative to the main frame 22, so the cab is vertically adjustable with the lower end of the escalator assembly.

Preferably, an interior of the cab 60 is climate controlled, with air conditioning and heating systems for operator comfort. The cab 60 is also preferably supplied with two laterally separated control station locations so that when the machine 10 is operated on one side of the ditch 42 the operator can clearly view the ditch and the placement of the padding 48 in the ditch from one of the control station locations, and when the machine is operated on the opposite side of the ditch the operator can clearly view the ditch and the placement of the padding in the ditch from the other control station location.

Figure 2:
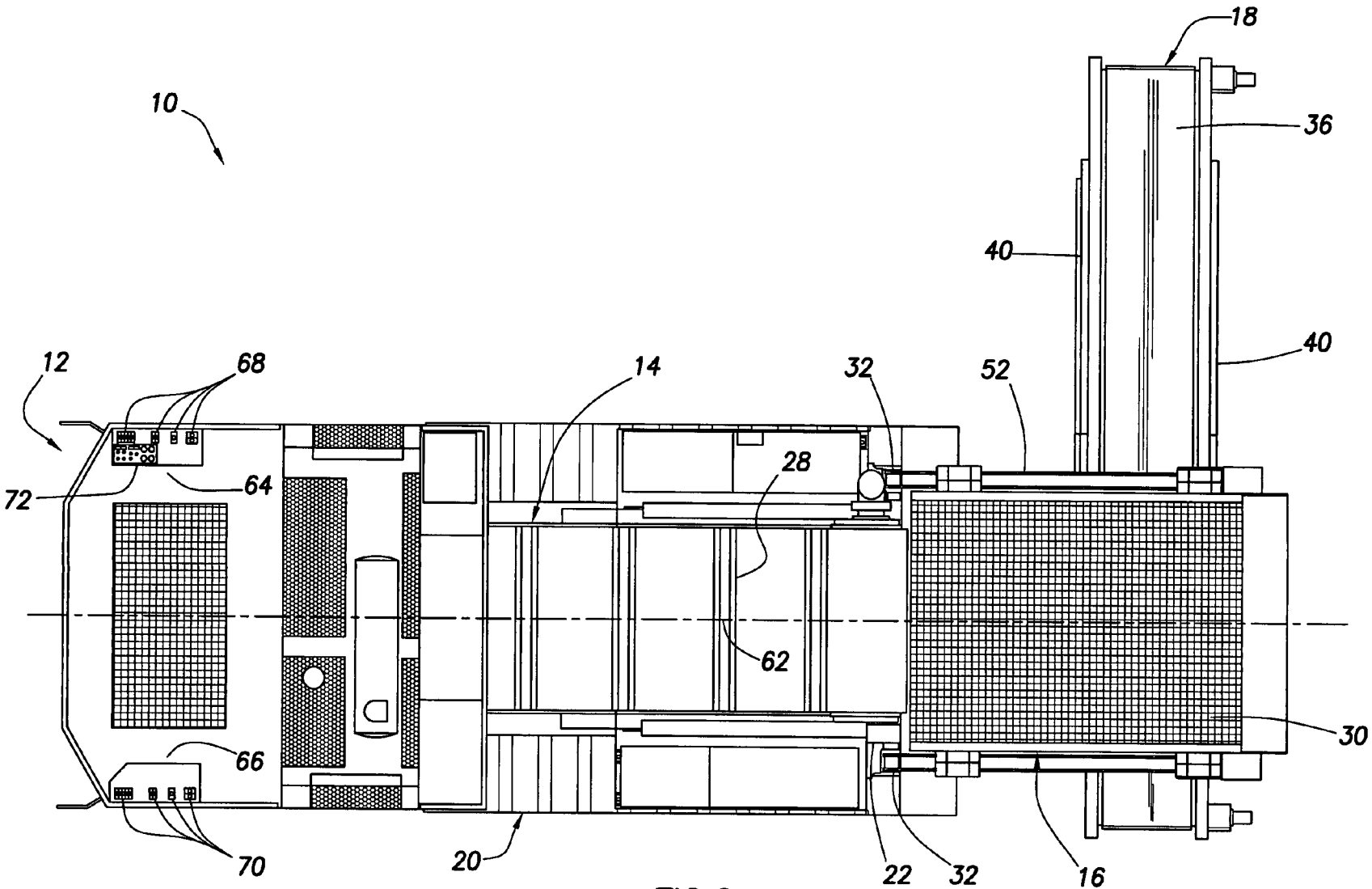
FIG. 2 is a plan view of the pipeline padding machine.

Referring additionally now to FIG. 2, the machine 10 is representatively illustrated from a top plan view with the cab 60 removed. Note that the machine 10 may be supplied either with or without the enclosed climate controlled cab 60 as desired.

In this view it may be seen that the machine 10 has a longitudinal axis 62. Control station locations 64, 66 are laterally separated on either side of the longitudinal axis 62. An operator may be positioned at the control station location 64 to manipulate control devices 68 while viewing the ditch 42 on one lateral side of the machine 10, and the operator may be positioned at the control station location 66 to manipulate control devices 70 while viewing the ditch on the opposite side of the machine.

In the embodiment of the machine 10 depicted in FIG. 2, the control devices 68 are separate from the control devices 70 (although they may each control the same functions of the machine) and they remain positioned at the respective control station locations 64, 66. However, note that a single set of control devices could be transported between the control station locations 64, 66, for example, by mounting the control devices 68 or 70 on a pivoting and/or sliding assembly, or by pivoting and/or sliding the cab 60 so that the control devices therein are transported with the cab between the control station locations, etc. In this manner, the same set of control devices 68 or 70 could be used at each location 64, 66.

It is not necessary for the same control devices to be positioned at each location 64, 66. For example, at the location 64 additional control devices 72 could be used. These control devices 72 could be for functions which the operator does not need to directly control at each location 64, 66.

Note that as depicted in FIG. 2 the conveyor assembly 18 is extended outwardly from an opposite lateral side of the machine 10 as compared to FIG. 1. In addition, the deflector 56 is not shown in FIG. 2.

Figure 3:
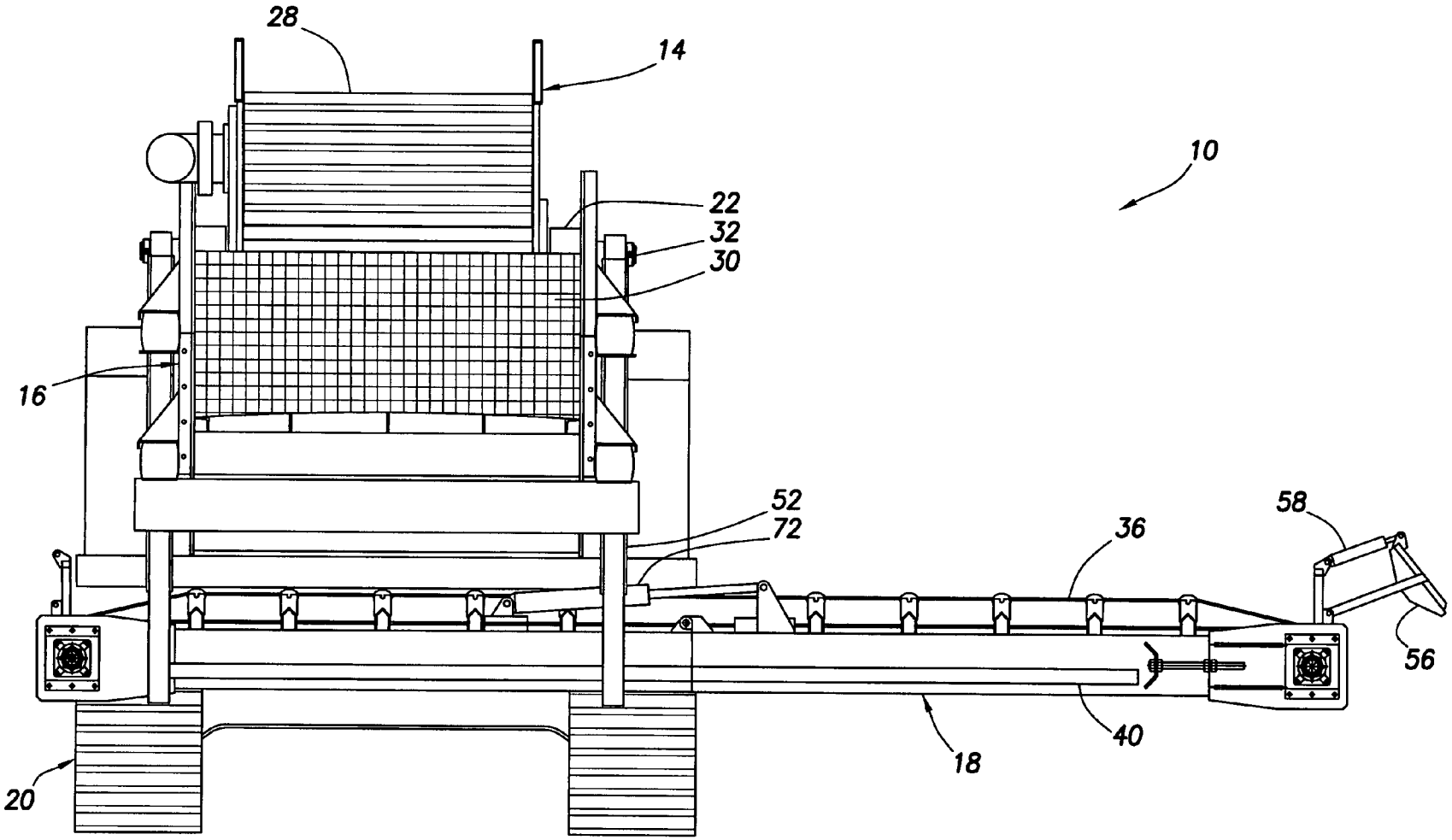
FIG. 3 is an end elevational view of the pipeline padding machine.

Referring additionally now to FIG. 3, the machine 10 is representatively illustrated from a rear elevational view. In this view the manner in which a hydraulic cylinder 72 is used to laterally adjust the position of the conveyor assembly 18 may be clearly seen.

Figure 4:
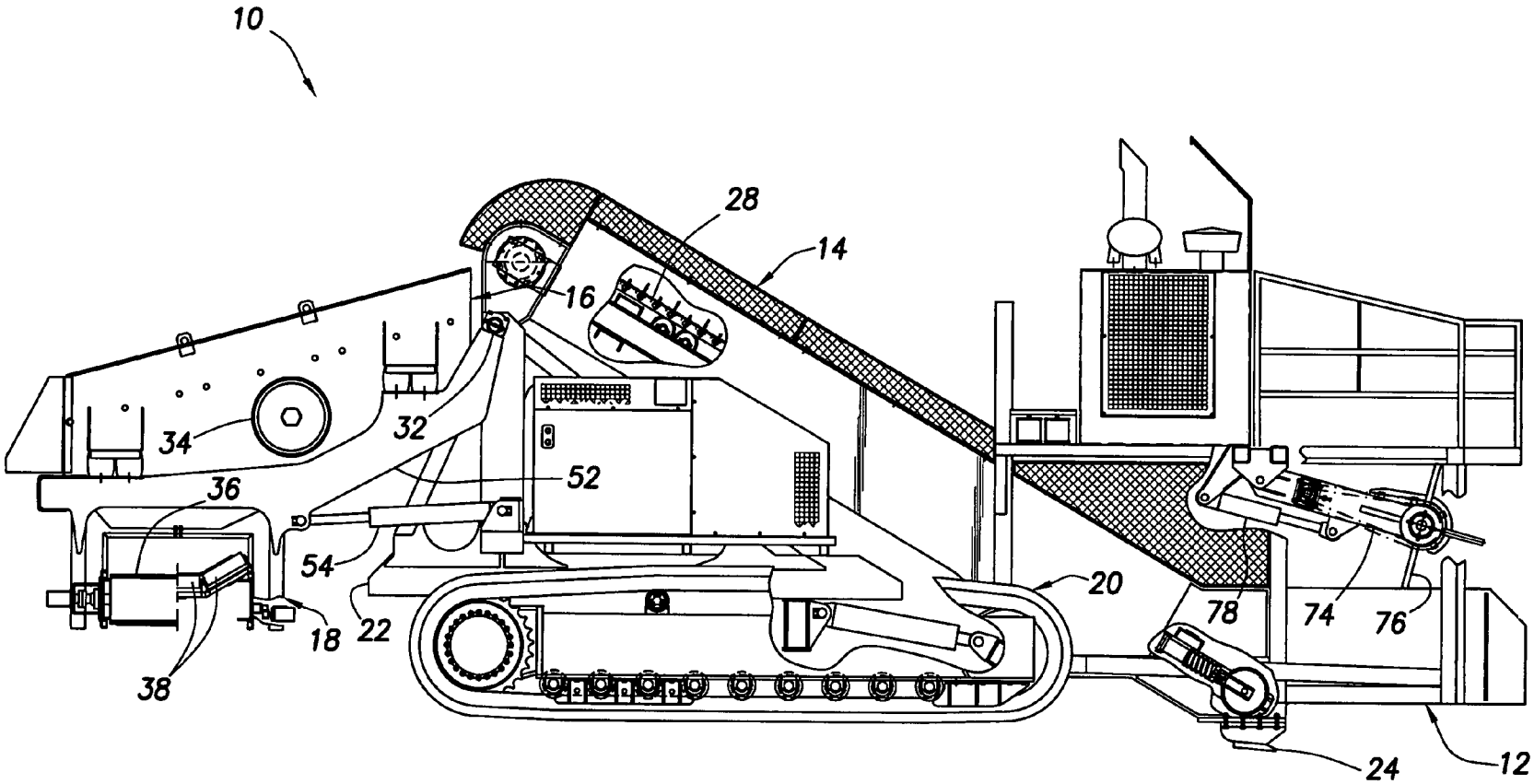
FIG. 4 is a side elevational view of the pipeline padding machine.

Referring additionally now to FIG. 4, the machine 10 is representatively illustrated from a side elevational view. In this view various details of the escalator, conveyor and collection assemblies 12, 14, 18 are shown.

A cutaway of the conveyor assembly 18 shows the rollers 38 used to support the belt 36. It is not necessary for the conveyor assembly 18 to include the belt 36 and rollers 38, since other types of conveyors (such as segmented or tracked-type conveyors, etc.) could be used instead.

A cutaway of the escalator assembly 14 shows how the flight sections 28 are connected to each other and displaced along the escalator flight. Other types of escalator assemblies (such as assemblies using belts, etc.) could be used in the place of the illustrated escalator assembly 14.

A cutaway of the collection assembly 12 shows an optional material conditioner 74 which may be used to condition the material 46. The conditioner 74 could, for example, sweep the material 46 toward the lower end of the escalator assembly 14, break up the material into smaller pieces, crush ice in the material or otherwise condition the material prior the material being elevated by the escalator assembly 14.

The conditioner 74 includes arms 76 which are rotated to condition the material 46. The arms 76 are vertically adjusted by means of a hydraulic cylinder 78 or other actuator which pivots the conditioner 74 relative to the lower end of the escalator assembly 14.

Figure 5:
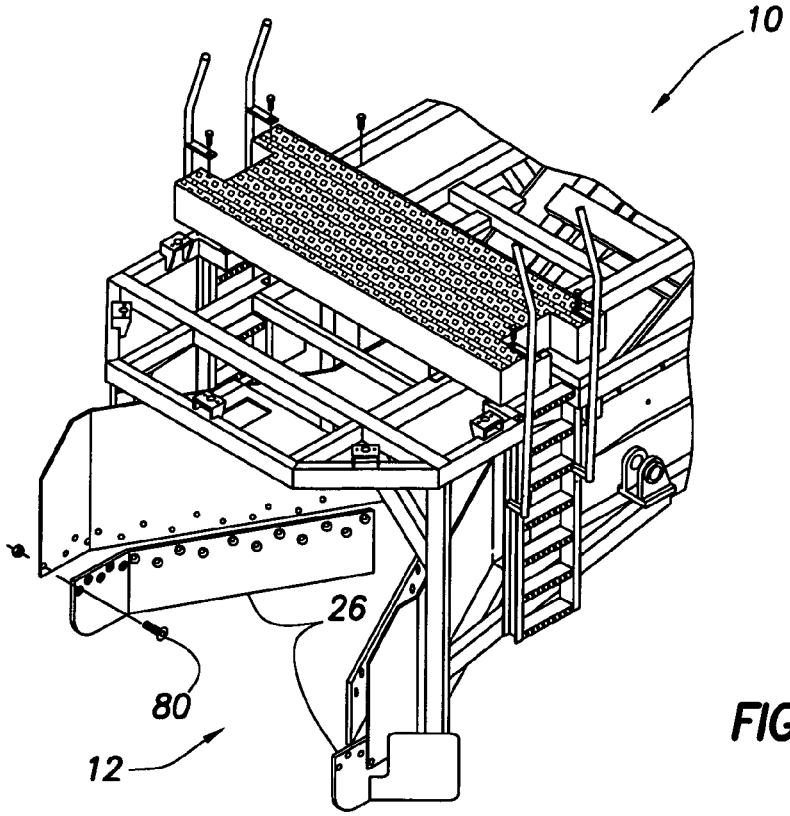
FIG. 5 is an isometric view of a material collection assembly of the pipeline padding machine.

Referring additionally now to FIG. 5, a portion of the machine 10 is representatively illustrated showing the manner in which the side walls 26 may be vertically adjusted. Mechanical fasteners 80 (such as screws, bolts, pins, etc.) may be used to fasten the side walls 26 in various vertical positions relative to the lower end of the escalator assembly 14 and the cutting edge 24. Other means of vertically adjusting the side walls 26 (such as actuators, etc.) may be used in keeping with the principles of the invention.

One advantage of the ability to vertically adjust the side walls 26 relative to the lower end of the escalator assembly 14 is that, if the lower end of the escalator assembly is raised or lowered (e.g., by pivoting the escalator assembly relative to the main frame 22 to compensate for varying terrain, etc.), the side walls 26 can be independently raised or lowered so that they are properly positioned to gather the material efficiently.

Figure 6:
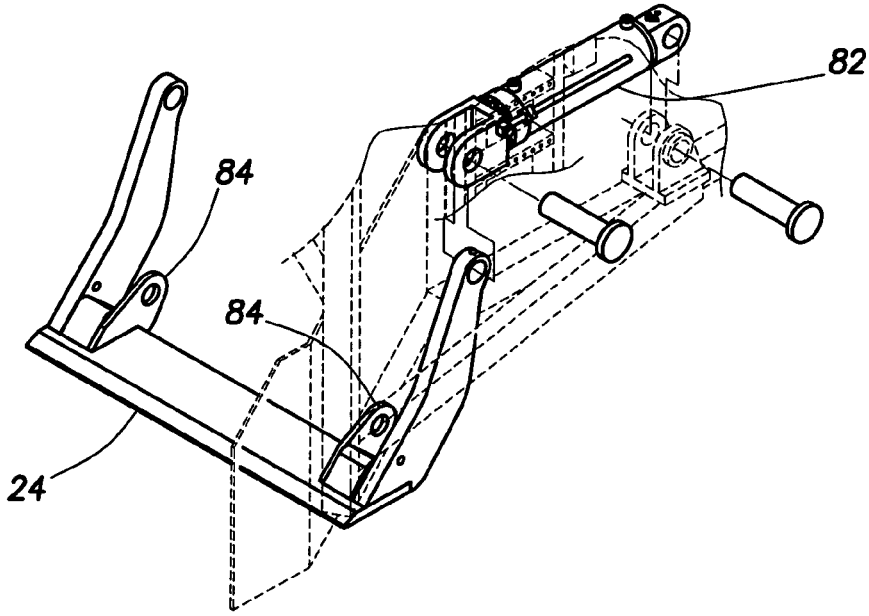
FIG. 6 is an enlarged isometric exploded view of a cutting assembly of the pipeline padding machine.

Referring additionally now to FIG. 6, the manner in which the cutting edge 24 may be pivoted relative to the lower end of the escalator assembly 14 is representatively illustrated. Specifically, a hydraulic cylinder 82 may be used to rotate the cutting edge 24 about pivots 84.

Preferably, the cutting edge 24 is pivotable up to about 25° below horizontal. In this manner the cutting edge 24 can be positioned at an optimum angle for cutting through and collecting the material 46, and can even be adjusted to cut into previously undisturbed ground.

If the cutting edge 24 is adjusted so that it is cutting into virgin ground, the side walls 26 are preferably vertically positioned so that their lower ends are at or just above the ground (i.e., the lower ends of the side walls are vertically higher than the cutting edge). If the cutting edge 24 is adjusted so that it cuts through the material 46, the side walls 26 are preferably adjusted so that their lower ends are even with or somewhat vertically lower than the cutting edge. Thus, it is a significant advantage of the machine 10 that both the side walls 26 and the cutting edge 24 can be adjusted relative to the lower end of the escalator assembly 14.

Figure 7:
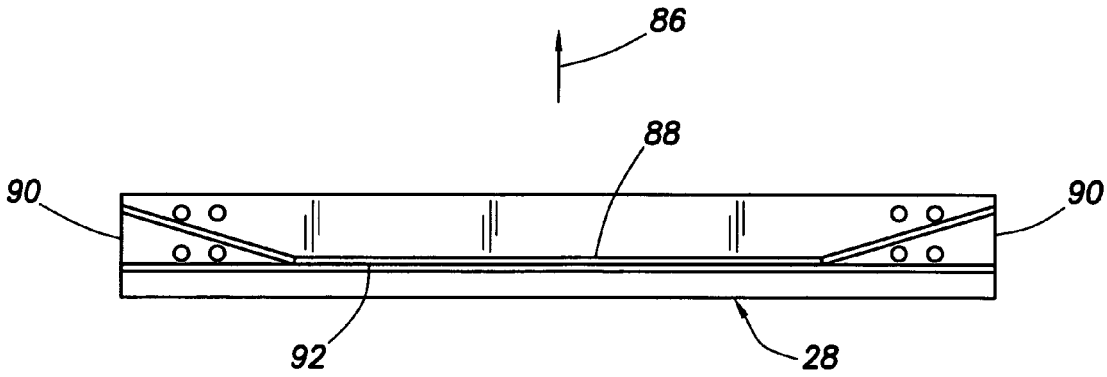
FIG. 7 is a plan view of a flight section used in an escalator assembly of the pipeline padding machine.

Referring additionally now to FIG. 7, one of the escalator flight sections 28 is representatively illustrated apart from the remainder of the machine 10. The flight section 28 is shown from a top plan view, with the direction of travel during normal operation of the escalator assembly 14 being indicated by an arrow 86.

In this view it may be seen that the flight section 28 includes a recess 88 which is concave in the direction of travel 86 of the flight section. This concave recess 88 permits wet material 46 to be conveyed more efficiently up the escalator assembly 14, and also aids in urging the material toward the middle of the flight section 28 and away from its lateral sides 90. This helps to prevent the material 46 from collecting at the sides of the escalator assembly 14.

Figure 8:
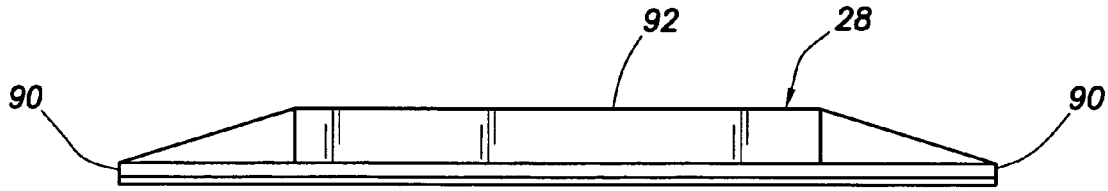
FIG. 8 is a side elevational view of the escalator flight section.

Referring additionally now to FIG. 8, the flight section 28 is depicted from a side elevational view. In this view it may be seen that an upstanding wall 92 is tapered toward the lateral sides 90 of the flight section 28, with the wall having a relatively tall middle portion between its tapered portions.

The tapered portions of the wall 92 also help to prevent accumulation of the material 46 at the sides of the escalator assembly 14. The relatively tall middle portion enables a greater quantity of the material 46 to be conveyed by each of the flight sections 28, thereby increasing the efficiency of the escalator assembly 14.

Note that it is not necessary for all of the flight sections 28 to be configured as depicted in FIGS. 7 & 8. For example, only every other flight section 28 might be configured as depicted in FIGS. 7 & 8, while the remaining flight sections are conventionally configured, etc.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A pipeline padding machine, comprising:

a first control station location for controlling operation of the machine while the machine is operated on a first lateral side of a ditch; and a second control station location for controlling operation of the machine while the machine is operated on a second lateral side of the ditch, wherein a first control station and a second control station concurrently exist at the respective first and second control station locations, and wherein the first and second control station locations are pivotable with a material escalator assembly relative to a main frame of the pipeline padding machine.

* * * * *